US006836908B1

(12) United States Patent
Chang

(10) Patent No.: US 6,836,908 B1
(45) Date of Patent: Jan. 4, 2005

(54) WATER CIRCULATION DEVICE

(76) Inventor: Pao-Cheng Chang, 12F-6, No. 262 Sec. 2 Chin Cheng Road, Tucheng, Taipei Hsien (TW)

( * ) Notice: Subject to any disclaimer, the term of this patent is extended or adjusted under 35 U.S.C. 154(b) by 0 days.

(21) Appl. No.: 10/790,076

(22) Filed: Mar. 2, 2004

(30) Foreign Application Priority Data

Feb. 2, 2004 (TW) ..... 093201438

(51) Int. Cl.[7] ..... A61H 33/04
(52) U.S. Cl. ..... 4/541.1; 4/541.1
(58) Field of Search ..... 4/506, 507, 541.1–541.6

(56) References Cited

U.S. PATENT DOCUMENTS 5,056,168 A * 10/1991 Mersmann ..... 4/541.6
5,063,620 A * 11/1991 Mersmann ..... 4/541.6
5,335,376 A * 8/1994 Kaldewei ..... 4/541.6
5,386,598 A * 2/1995 Mersmann ..... 4/541.4

* cited by examiner

*Primary Examiner*—Gene Mancene
*Assistant Examiner*—Huyen Le
(74) *Attorney, Agent, or Firm*—Troxell Law Office PLLC

(57) ABSTRACT

A water circulation device comprising a hood consists of several water inlet holes and a larger water outlet hole; a water outlet plate with a passing hole in on the center; a revolving plate consists of several protruding stripes surrounding the center and an axis hole is on the center; a container consists of a containing chamber with a chamber hole is on the center for the revolving plate the water outlet plate to be installed inside and is covered by the hood, the containing chamber connects to a back base installed on the inner wall of the water tank, an external motor connects to an axis hole and bring said revolving plate turning, water comes in from the water inlet holes and is ejected from the water outlet hole more stronger.

9 Claims, 4 Drawing Sheets

WATER CIRCULATION DEVICE

BACKGROUND OF THE INVENTION

I. Field of the Invention

This invention relates generally to a water circulation device and, more specifically, to a water circulation device that offers a simple and inexpensive way to circulate water for a better sanitary effect.

II. Description of the Prior Art

Heretofore, it is known that the water circulation devices are around and most people are not aware of them; the purpose of the water circulation devices is to circulate water, the water might be clean water or contain some cleaning materials, therefore SPA's, springs, and swimming pools all have water circulation devices to circulate water.

The known circulation devices are very complex, the common one as applied in SPA's is to draw out the water from water tank through water pipes and pour the water back for circulation.

Such methods can do the circulation of water, however they need pipes to go around, the pipes need installation and maintenance cost, and as we all know, after sometimes, those pipes will retain stain or other dirty materials, at this time, if user want to clean those pipes is impossible, replacement is the only way; the pipes will cause certain hygienic problems.

SUMMARY OF THE INVENTION

It is therefore a primary object of the invention to provide a water circulation device that offers a simple and inexpensive way to circulate water for a better sanitary effect.

In order to achieve the objective set forth, a water circulation device in accordance with the present invention comprises a hood consists of several water inlet holes and a larger water outlet hole; a water outlet plate with a passing hole in on the center; a revolving plate consists of several protruding stripes surrounding the center and an axis hole is on the center, a container consists of a containing chamber with a chamber hole is on the center for the revolving plate the water outlet plate to be installed inside and is covered by the hood, the containing chamber connects to a back base installed on the inner wall of the water tank, an external motor connects to an axis hole and bring said revolving plate turning, water comes in from the water inlet holes and is ejected from the water outlet hole more stronger.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
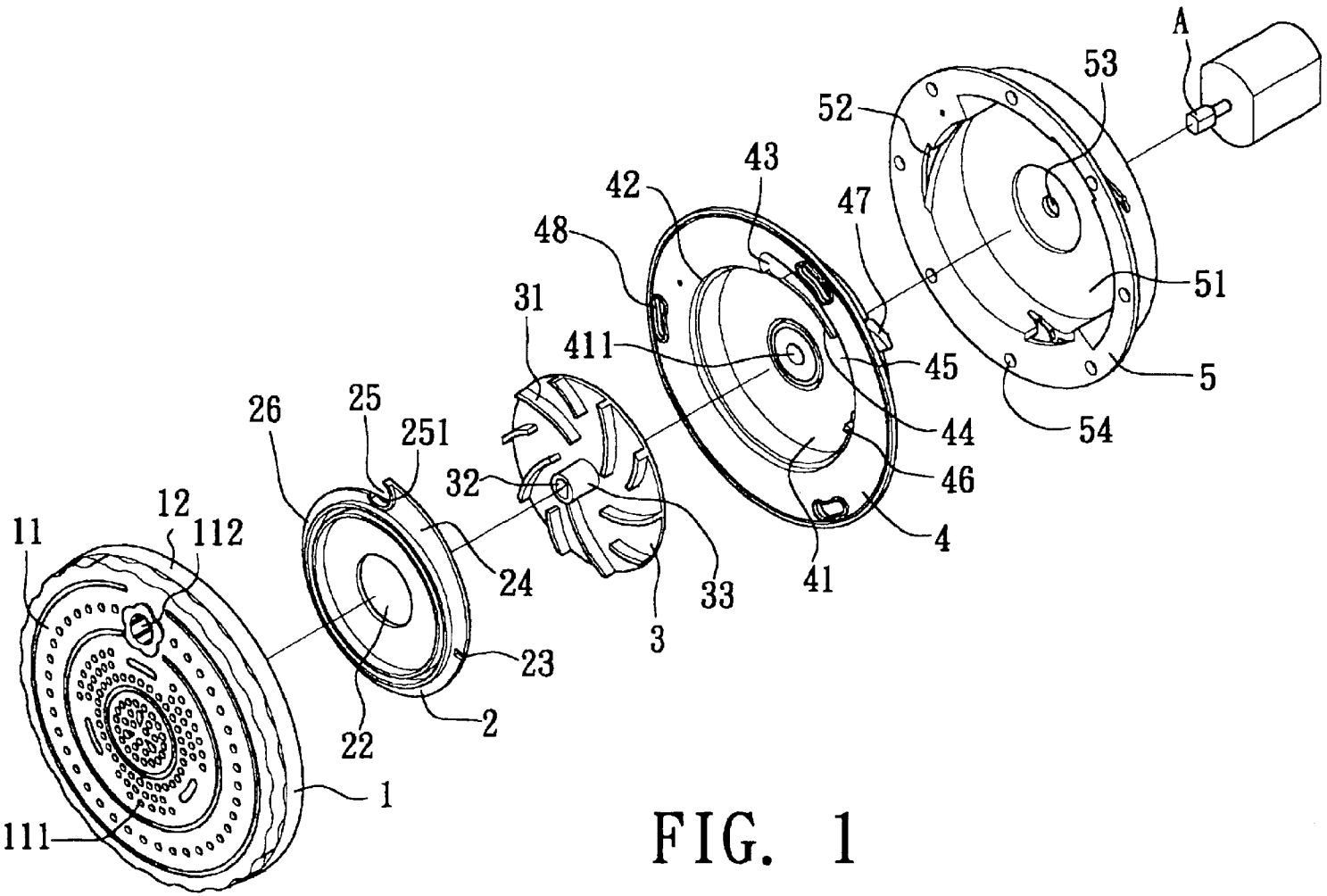
FIG. 1 is an assembly view of the present invention.
Figure 3:
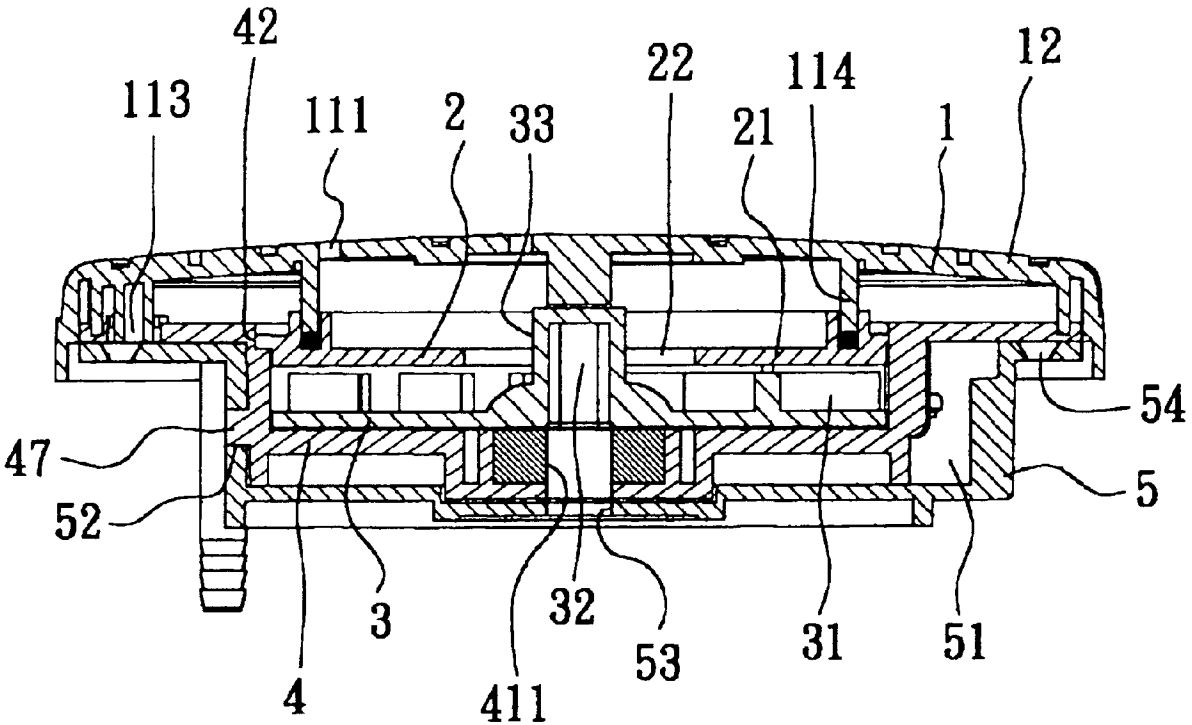
FIG. 3 is a cross-sectional view of the present invention.

Referring to all Figs., the present invention comprises a hood 1, a water outlet plate 2, a revolving plate 3, a container 4 and a back base 5. The function of each component is described as following:

The hood 1 is in cover shape with certain depth comprising a hood surface 11 and a hood brim 12, several water inlet holes 111 and a larger water outlet hole 112 to combine with the container 4 are on the hood surface 11; several fasteners 113 (as shown in FIG. 3) are on the inner side of the hood surface 11; a cover ring 114 (as shown in FIG. 3) is on the inner side of the hood surface 11 for the water outlet plate 2 to position.

The water outlet plate 2 is in plate shape with an indentation 21 on top, the size of the indentation 21 corresponds to the cover ring 114 for the cover ring 114 to inlay; a passing hole 22 in on the center of the water outlet plate 2 for water to come in, the other side has a gap 23 for the container 4 to position; a whirlpool shape extension slice 24 is on the outside of the water output plate 2, a semicircle hole 25 is on the end of the extension slice 24, a vertical extension tenon 251 is on the semicircle hole 25; a round slice 26 with height difference is on the periphery of the indentation 21, the extension slice 24 and the round slice 26 are combined into one body and extend outward; in other application, the hood 1 and the water outlet plate 2 can also be combined into one body, the whirlpool shape extension 24 of the water outlet plate 2 can be in vertical direction; the whirlpool shape extension 24 can also be separated.

The revolving plate 3 is in plate shape, several protruding stripes 31 surrounding the center are on one side of the revolving plate 3, the protruding stripes 31 can be in different length or with the same length and separate with each other, an axis hole 32 is on the center of the revolving plate 3, a center tenon 33 surrounds the axis hole 32 to connect to the axis of an external motor.

The container 4 is in shell shape with depth in vertical direction, a containing chamber 41 with a chamber hole 411 is on the center of the container 4, the size of the containing chamber 41 corresponds to the revolving plate 3 to contain the revolving plate 3; an outer hole 42 corresponding to and larger than the water outlet plate 2 is on the outer rim of the containing chamber 41; a hole path 43 in curve shape and concave inward is on the end of the outer hole 42, the hole path 43 with a wall hole 45 is formed by the a wall 44 protruding from the containing chamber 41; a protruding stem 46 corresponds to the gap 23; the revolving plate 3 is installed in the containing chamber 41, the water outlet plate 2 is inlaid into the outer hole 42 of the containing chamber 41, the protruding stem 46 is inserted into the gap 23 for positioning. In order to combine with the back base 5, the back of the container 4 has a fastener 47 or equivalent component; several fastener holes 48 corresponding to the fasteners 113 of the hood 1 are on the front of the container 4.

The back base 5 is in shell shape with depth in vertical direction consists of a base containing chamber 51 to contain the container 4 and a fastener hole 52 for the fastener 47 of the container 4 to buckle; a through hole 53 on center for the axis of an external motor to pass; the other external devices can also be installed, such as a connector to link to the water tank and holes 54, those components are not limited in real application.

Figure 2:
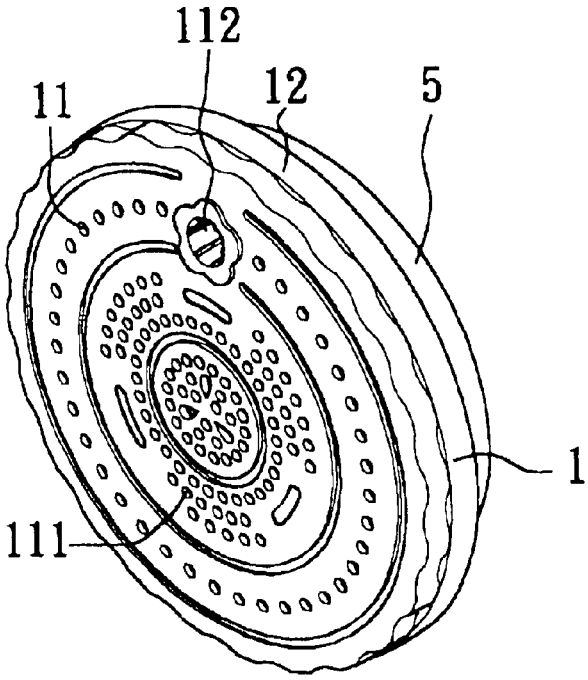
FIG. 2 is a perspective view of the present invention.

Referring to all Figs., while assembly, users install the revolving plate 3 into the container 4 first, then put the water outlet plate 2 onto the outer hole 42, the protruding stem 46 is inserted into the gap 23 for positioning, the fastener hole 48 of the container 4 is buckled on the hood 1 and finish the assembly; at the same time the fastener 47 of the container 4 is buckled on the fastener hole 52 of the bask base 5, as shown in FIG. 2 and FIG. 3.

While installation, the present invention can be fastened on the inner wall of the water tank and connect ed to an external motor, the axis A of the motor is connected and wrapped by the axis hole 32 of the revolving plate 3; when the motor rotates, it brings the revolving plate 3 at the same time. The cost saving method is to omit the back base 5 and connects the present invention directly to the inner wall of the water tank.

Figure 4:
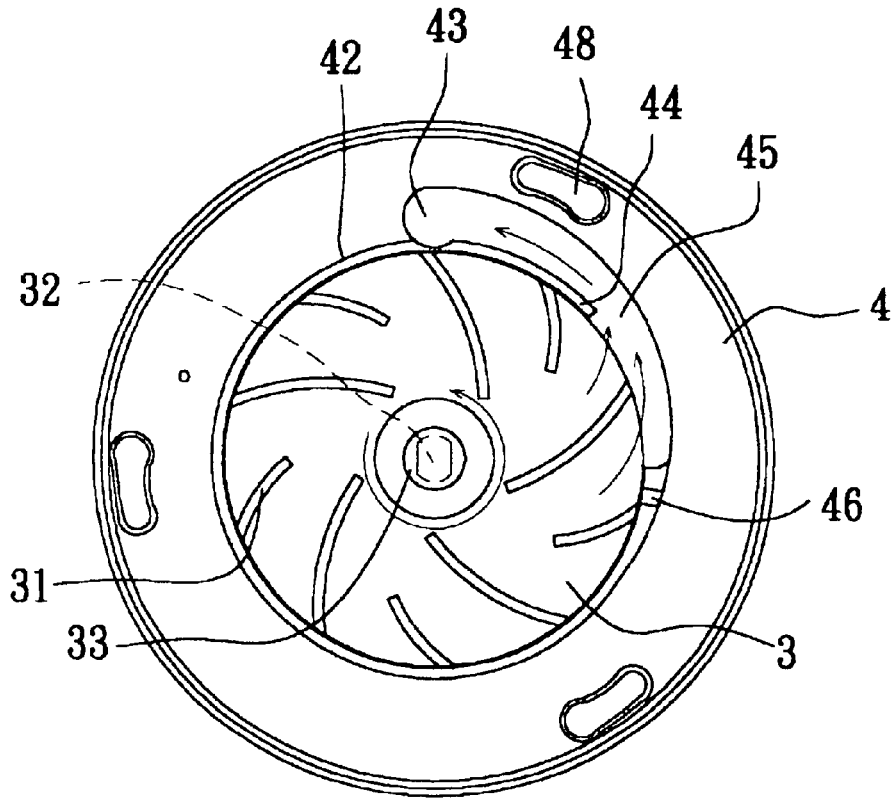
FIG. 4 is an application view of the present invention.

Referring to FIG. 4, when motor rotates, the revolving plate 3 is brought along and turning, water is sucked into the container 4 through the water inlet holes 111 and the passing hole 22; by the turning of the revolving plate 3, water is pushed to the hole path 43 and ejected through the water outlet hole 112 for circulation.

The present invention has following advantages:

(1) The structure is very simple, all the components are made into several single bodies, they can be assembled in advance, the mold tooling specification and size are stable.

(2) The assembly is very easy, except the fixing lock on the back base, the other components can be assembled by hands without tools; they are all made of plastic material and injected from machines, the size is very stable.

(3) The maintenance and cleaning is very easy, when users do the periodical cleaning, they only have to tear off and clean the hood, the water outlet plate, the revolving plate and the back base, such scheme avoids the condition that the known pipes cannot be cleaned, this is very important to the sanitary of the water supplied.

(4) Flexibility of installation, all the components can be controlled separately, all the components are installed separately and different from the known systems that have to be in a unity; while installation, users are very flexible to handle installation based on real situation; at the same time, the starting and control can be handled separately.

While a preferred embodiment of the invention has been shown and described in detail, it will be readily understood and appreciated that numerous omissions, changes and additions may be made without departing from the spirit and scope of the invention.

What is claimed is:

1. A water circulation device comprising:

a hood is in cover shape with certain depth, several water inlet holes and a larger water outlet hole are on the hood surface, a cover ring is on the inner side of said hood surface;

a water outlet plate is in plate shape with an indentation on top, the size of said indentation corresponds to said cover ring for said cover ring to inlay, a passing hole in on the center of said water outlet plate for water to come in, the other side has a gap, a whirlpool shape extension slice is on the outside of said water output plate, a hole is on the end of said extension slice, a vertical extension tenon is on said hole, a round slice with height difference is on the periphery of said indentation, said extension slice and said round slice are combined into one body and extend outward;

a revolving plate is in plate shape, several protruding stripes surrounding the center are on one side of said revolving plate, an axis hole is on the center of said revolving plate, a center tenon surrounds said axis hole to connect to the axis of an external motor; and a container is in shell shape with depth in vertical direction, a containing chamber with a chamber hole is on the center of said container, the size of said containing chamber corresponds to said revolving plate to contain the revolving plate, an outer hole corresponding to and larger than said water outlet plate is on the outer rim of said containing chamber, a hole path in curve shape and concave inward is on the end of said outer hole, said hole path with a wall hole is formed by the a wall protruding from said containing chamber, a protruding stem corresponds to said gap for positioning, the back of said container has a fastening device to combine others;

whereby said revolving plate and said water outlet plate are installed inside said container and is covered by said hood, the combination is further linked to the inner wall of the water tank, an external motor connects to said axis hole and bring said revolving plate turning, water comes in from said water inlet holes and is ejected from said water outlet hole.

2. The water circulation device recited in claim 1, wherein said hole of said water outlet plate is in semicircle shape.

3. The water circulation device recited in claim 1, wherein said protruding stripes of said revolving plate have different length.

4. The water circulation device recited in claim 1, wherein the combination of said hood and said container is fasteners and fastener holes.

5. The water circulation device recited in claim 1, wherein a back base is in shell shape with depth in vertical direction consists of a base containing chamber to contain said container and a fastener hole for said fastener of said container to buckle, a through hole on the center for the axis of an external motor to pass; the other external fastening devices are installed to link to the inner wall of the water tank.

6. The water circulation device recited in claim 5, wherein the combination of said back base and said container is a fastener and a fastener hole.

7. A water circulation device comprising:

a hood consists of several water inlet holes and a larger water outlet hole;

a water outlet plate with a passing hole in on the center;

a revolving plate consists of several protruding stripes surrounding the center and an axis hole is on the center;

a container consists of a containing chamber with a chamber hole is on the center for said revolving plate said water outlet plate to be installed inside; and whereby said revolving plate and said water outlet plate are installed inside said container and is covered by said hood, the combination is further linked to the inner wall of the water tank, an external motor connects to said axis hole and bring said revolving plate turning, water comes in from said water inlet holes and is ejected from said water outlet hole.

8. The water circulation device recited in claim 7, wherein an extension slice is on the outside of said water output plate, a hole is on the end of said extension slice, a hole path in curve shape and concave inward is on a outer hole of said container for water to flow out.

9. The water circulation device recited in claim 7, wherein a back base consists of a base containing chamber to contain said container and a fastener hole for said fastener of said container to buckle, a through hole on the center for the axis of an external motor to pass; the other external fastening devices are installed to link to the inner wall of the water tank.

* * * * *